United States Patent [19]

Kostylev et al.

[11] Patent Number: 4,653,596

[45] Date of Patent: Mar. 31, 1987

[54] PERCUSSIVE AIR TOOL

[75] Inventors: Alexandr D. Kostylev; Jury N. Syryamin; Boris N. Smolyanitsky; Vladimir P. Boginsky; Alexei D. Terskov; Elena G. Mjuntser; Anatoly M. Petreev, all of Novosibirsk, U.S.S.R.

[73] Assignee: Institut Gornogo Dela Sibirskogo Otdelenia An SSSR, Novosibirsk, U.S.S.R.

[21] Appl. No.: 783,276

[22] Filed: Oct. 4, 1985

Related U.S. Application Data

[63] Continuation of Ser. No. 482,067, Apr. 5, 1983, abandoned.

[51] Int. Cl.[4] ..... B25D 17/06

[52] U.S. Cl. ..... 173/135; 173/139; 91/234

[58] Field of Search ..... 173/91, 92, 134–138, 173/127, 129, 139, 90; 91/232, 234

[56] References Cited

U.S. PATENT DOCUMENTS

| | | | |
|---|---|---|---|
| 3,756,328 | 9/1973 | Sudnishnikov et al. | 173/139 |
| 4,160,486 | 7/1979 | Kostylev et al. | 173/135 |

*Primary Examiner*—Donald R. Schran
*Assistant Examiner*—James L. Wolfe
*Attorney, Agent, or Firm*—Fleit, Jacobson, Cohn & Price

[57] ABSTRACT

A percussive air tool with a hollow cylindrical stepped housing having air inlet and air exhaust ports. A stepped hammer reciprocates inside the housing and has an axial central bore with a tube element disposed in the bore. The tool includes, work stroke and return stroke chambers, an air supply hose pipe with an air feeding valve, and a rod-clamping device arranged in the forward portion of the housing. The smaller step of the hammer has a neck portion or groove adapted to communicate the air inlet port with the interior of the larger step of the housing, an open annular cavity being formed between the tube element and the walls of the hammer bore.

6 Claims, 4 Drawing Figures

PERCUSSIVE AIR TOOL

This application is a continuation of application Ser. No. 482,067, filed Apr. 5, 1983 now abandoned.

This invention relates generally to civil engineering, and more specifically it concerns percussive air tools for driving into the ground rod-like pieces.

The device according to the invention can find application for driving into the ground earthing electrodes, tie anchors, etc., i.e. rod-like pieces having a diameter incomparably smaller than their length.

There are known at present several types of rod-driving tools.

More particularly, there is known a hydraulically-operated tool for sinking into the ground rod-like earthing electrodes. The tool is generally a power cylinder having a piston with a hollow stem arranged on both sides thereof, the electrode to be sunk in being disposed inside the hollow stem. A clamp means is fixedly secured on the lower end of the stem, whereas the housing of the power cylinder is rigidly secured by clamps to a power transmission line support.

The above known hydraulically-operated tool suffers from a disadvantage residing in its excessive size and weight and the need to affix the tool to a power transmission line support. Further, sinking earthing rods into firm grounds is complicated, while sinking them into frozen grounds is virtually impossible, since static loads exerted by the power cylinder are not sufficient for forcing the earthing electrodes into the ground.

There are also known percussive air tools comprising a housing accommodating a hammer reciprocating therein, the lower portion of the housing containing rod-clamping means. These percussive tools are attached to the upper portion of a rod-like piece to drive it into the ground by imparting a driving force to the upper end face thereof.

These percussive air tools suffer from a disadvantage residing in that driving rod-like pieces having a diameter by far smaller than their diameter is complicated due to a tendency of such pieces to bend or deform during driving in.

Further known are pneumatically-operated percussive tools comprising a hollow stepped housing of cylindrical shape having ports for feeding and discharging compressed air, the housing having arranged for reciprocations therein a stepped hammer provided with an axial bore, a tube element disposed inside the axial bore of the hammer, and work stroke and return stroke chambers defined by the surfaces of the elements of the percussive tool. The forward portion of the housing accommodates a rod-clamping means. Compressed air is supplied to the percussive tool along an air hose through an air feeding valve.

These pneumatically-operated percussive tools are capable of driving into the ground rod-like pieces having a diameter incomparably smaller than their length. Such rod-like pieces are driven into the ground by the application of impact loads to their side surfaces at such a distance from the ground as to prevent deformation of the rod during driving in.

However, the above percussive tools are not sufficiently reliable in operation and are complicated to manufacture. These disadvantages are accounted for by the fact that three friction surfaces are made use of between the housing of the tools and the tube elements, whereas coaxiality of the cylindrical mating surfaces of various elements is rather difficult to ensure. As a consequence, this lack of coaxiality may result in jamming of the hammer inside the housing whereby the tool stops. Alternatively, such a lack of coaxiality may result in malfunctioning of the tool or reduced impact strength and efficiency due to increased friction.

Further, to assure operability of the above percussive tools, it is necessary to heat-treat the elements thereof and polish their mating surfaces which increases the manufacturing costs involved.

Another disadvantage of the known percussive tools is excessive specific consumption of compressed air, because their work stroke chambers communicate continuously with the compressed air feeding line to result in leaks of the compressed air to the exhaust chambers and overflows of the compressed air to the return stroke chambers.

One more disadvantage is a relatively short service life of the above percussive air tools generally caused by failure of the rigid attachment of the air feeding valve to the housing which is subjected to considerable dynamic loads. Also, this makes the percussive tools less safe to operate, since when breaking away from the housing the air feeding valve may inflict injuries to the operator.

It is a principle object of the present invention to provide a percussive air tool of such a construction as to improve its reliability and extend its service life.

Another object is to reduce the specific consumption of compressed air needed for operation of the tool.

Yet another object is to simplify the manufacture of the percussive air tool.

One more object is to provide a percussive air tool which is more safe to operate.

These objects and advantages of the invention are attained by that in a percussive air tool for driving into the ground and withdrawing therefrom substantially rod-like pieces comprising a hollow cylindrical housing of stepped configuration, the housing having an air inlet port and an air exhaust port, a stepped hammer having a central axial bore and disposed inside the housing to reciprocate therein, a work stroke chamber and a return stroke chamber, an air supply hose pipe, an air feeding valve, and a rod-clamping means arranged in the forward portion of the housing, according to the invention, the smaller step of the hammer has a neck portion adapted to communicate the air inlet port with the interior of the larger step of the housing, an open annular cavity being formed between the tube and bore walls of the hammer.

One modification of the percussive air tool according to the invention provides that the work stroke chamber is defined by the neck portion of the hammer and the walls of the housing, whereas the return stroke chamber is defined by the annular cavity and the walls of the housing and those of the tube element.

An alternative modification of the percussive tool according to the invention provides that the work stroke chamber is defined by the annular cavity, walls of the housing and walls of the tube element, whereas the return stroke chamber is defined by the neck portion of the hammer and the walls of the housing.

Preferably, the ratio of the volume of the return stroke chamber to the volume of the work stroke chamber is within $\frac{1}{3}$ to $\frac{1}{4}$.

In order to reduce peak dynamic loads at the location where the air feeding valve is connected to the housing, it is preferable that a ring shell be secured to the outer surface of the housing by means of shock-absorbing elements, the ring shell being rigidly affixed to the air feeding valve.

This structural arrangement of the percussive air tool enables to improve its reliability and increase its durability, as well as to bring down the specific consumption of compressed air and make the device easier to fabricate.

The essence of the proposed invention resides in the provision of a percussive air tool having such working chambers as to effect a simultaneous action of compressed air on the opposite end faces of the hammer whereby the hammer moves in a direction of its end face having a smaller effective area. Such a manner of controlling the movements of the hammer makes it possible to dispense with one friction surface, particularly the friction surface between the hammer and the tube, which in turn enables to obviate the need for precision machining of the inner surface of the hammer and the outer surface of the tube, or even to use less expensive materials for the tube, such as plastics, polymers, etc.

The application of the present invention in the construction of percussive air tools enables to reduce the specific consumption of compressed air by 25 to 30 percent versus the prior art devices and increase their service life by as much as 30 to 50 percent, as well as to improve their operational reliability.

Other objects and advantages of the present invention will become more fully apparent from a more detailed description that follows taken in conjunction with the accompanying drawings, in which.

Figure 3:
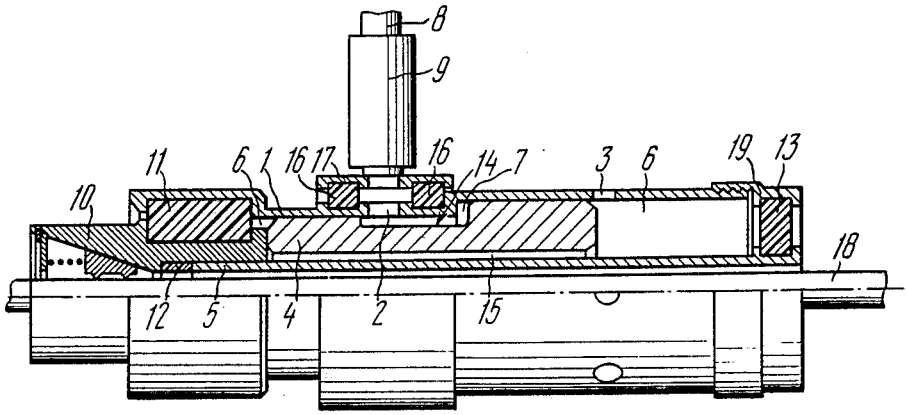
Figure 4:
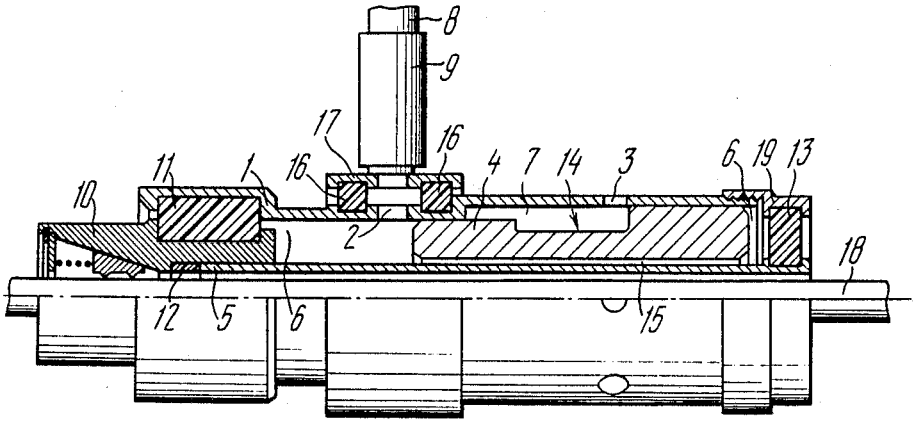

FIG. 3 shows a longitudinal sectional view of another modified form of the percussive air tool according to the invention having a work stroke chamber defined by an annular cavity between the hammer and a tube element, walls of the housing and those of the tube, the return stroke chamber being defined by a neck portion of the hammer and the inner walls of the housing; and FIG. 4 is a sectional view of the percussive air tool shown in FIG. 3 showing the hammer in the rear position (termination of the return stroke), that is when compressed air is discharged from the return stroke chamber.

Figure 1:
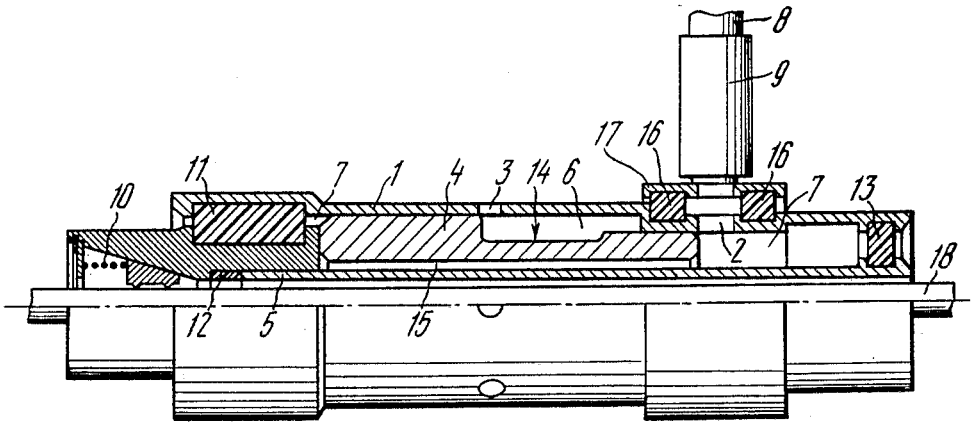
FIG. 1 is a longitudinal sectional view of one possible modification of a percussive tool according to the invention, a hammer thereof being shown in its forward position, i.e. when delivering an impact.
Figure 2:
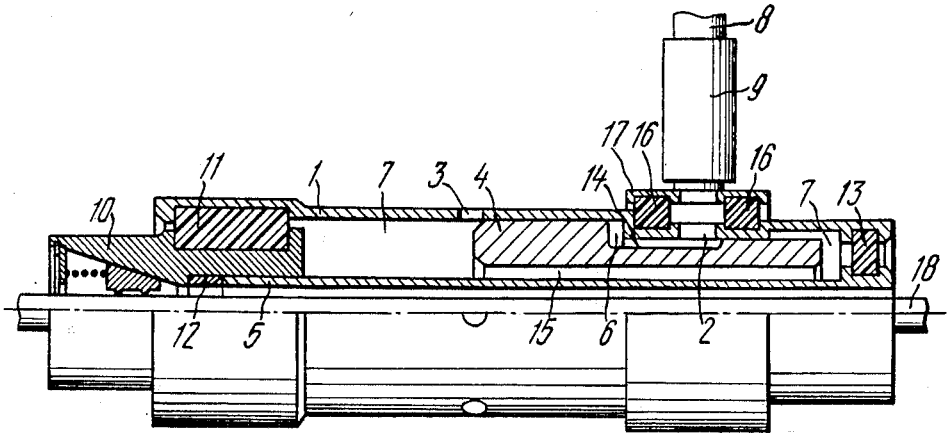
FIG. 2 is a sectional view of the percussive air tool according to the invention as shown in FIG. 1 illustrating a rear position of the piston hammer, i.e. when compressed air is discharged from a return stroke chamber.

With reference to FIGS. 1 and 2, the percussive air tool according to the invention comprises a stepped housing 1 hollow inside and generally cylindrical in shape, the housing having an inlet port 2 for feeding compressed air and air discharge ports 3. A stepped hammer 4 having a central axial bore is disposed inside the housing 1, the axial bore of the hammer 4 accommodating a tube 5. In order to assure reciprocations of the hammer 4 inside the housing 1, there are provided a work stroke chamber 6 and a return stroke chamber 7. A hose pipe 8 is provided to supply air from a compressor, this hose pipe 8 being connected to an air feeding valve 9. In order to simplify the manufacture of the device, as well as to reduce the amount of dynamic loads imposed on the housing thereof, it is advisable that a rod-clamping means 10 be provided in the forward portion of the housing 1 to be secured therein by a rubber shock-absorber 11. The tube 5 is adapted to enter by its front end into the clamping means 10 to thrust against a resilient ring 12, the rear end of the tube 5 being secured inside the housing 1 by means of a rubber shock-absorbing element 13.

The smaller step of the hammer 4 has a neck portion 14 serving to communicate the inlet port 2 with the larger step of the housing 1, an open annular cavity 15 being defined by a spacing between the axial or bore of the hammer 4 and the tube 5.

The work stroke chamber 6 is defined by the neck 14 of the hammer 4 and walls of the housing 1, whereas the return stroke chamber 7 is defined by the annular cavity 15, walls of the tube 5 and inner walls of the housing 1.

Secured on the outer surface of the housing 1 by means of shock-absorbing elements 16 is a ring shell 17 rigidly connected to the air feeding valve 9. A rod 18 to be driven is passed through the interior of the tube 5.

The percussive air tool according to the invention operates as follows.

After turning a handle of the valve 9, compressed air is admitted through the inlet port 2 to the return stroke chamber 7, whereby the compressed air acts to exert pressure on the end faces of the larger and smaller steps of the hammer 4. Because the end face area of the larger step of the hammer 4 is substantially greater than the end face area of the smaller step thereof, the hammer is caused to start its return stroke, i.e. to move from the position best seen in FIG. 1 to the right. At the end of the return stroke or when the hammer 4 assumes the position best seen in FIG. 2 the discharge ports 3 open to release the air from the return stroke chamber 7. Concurrently, the inlet port 2 opens again for the compressed air to be admitted through the passage defined by the neck portion 14 of the hammer 4 and the wall of the smaller step of the housing 1 to the work stroke chamber 6, whereby the hammer 4 executes its work stroke (it moves to the left from the position illustrated in FIG. 2) to terminate its movement in an impact delivered on the clamp means 10 (the moment of impact is shown in FIG. 1). Therewith, the discharge ports 3 open for the compressed air to be released from the work stroke chamber 6 to the outside, while compressed air from the compressor is again admitted through the inlet port 2 to the return stroke chamber 7 and the hammer 4 executes its return stroke (it moves to the right from the position shown in FIG. 1), whereafter the heretofore described cycle is recommenced. Under the action of impacts delivered by the hammer and imparted by the clamp means 10 to the rod 18, the latter is driven into the ground.

A percussive air tool illustrated in FIGS. 3 and 4 is one of the alternative embodiments of the present invention. In contrast to the aforedescribed, in this construction of the percussive tool the work stroke chamber is defined by the annular cavity 15 between the tube 5 and the hammer 4, as well as by the walls of the housing 1 and those of the tube 5. The return stroke chamber 7 is defined by the neck portion 14 of the hammer 4 and the walls of the housing 1. The rear end of the tube 5 is secured by means of the shock-absorbing element 13 in a nut member 19 threadingly engaged with the larger step of the housing 1.

The modification of the percussive air tool shown in FIGS. 3 and 4 operates in a manner similar to the one described with reference to the modification illustrated in FIGS. 1 and 2.

What is claimed is:

1. A percussive air tool for driving into the ground and withdrawing therefrom substantially rod-like pieces, said tool comprising: a hollow housing of a cylindrical stepped configuration having a pair of spaced ends; air inlet and air exhaust ports arranged in said housing; a stepped hammer disposed inside said housing for reciprocation therein and having a central axial bore, said hammer including a front face, a rear face spaced from said front face, and an intermediate neck portion of reduced outer diameter, said intermediate neck portion and said hollow housing defining a first stroke chamber; a tube element positioned inside the axial bore of said hammer and spaced inwardly therefrom, said tube element, said hammer, and said housing defining a second stroke chamber; said air exhaust port including at least one opening in said housing intermediate the ends thereof for communication alternately with said first stroke chamber and said second stroke chamber so each of said chambers alternately communicates with the same at least one opening; an air supply hose pipe with an air feeding valve for feeding compressed air to said chambers of said stepped hammer; a rod-clamping means arranged in the forward portion of said housing; said neck portion arranged at a smaller step of said hammer to communicate said air inlet port with the interior of a larger step of said housing; and a continuous annular cavity formed by an outer wall of said tube element and the walls of said axial bore of said hammer, said cavity extending from the front face of said hammer to the rear face thereof and providing continuous communication between the front and rear faces of said hammer.

2. A percussive air tool as defined in claim 1 wherein said first stroke chamber is a work stroke chamber defined by said neck portion and inner walls of said housing, said second stroke chamber being a return stroke chamber defined by said annular cavity, the front and rear faces of said hammer, the axial bore of said hammer, the walls of said housing and the outer wall of said tube element.

3. A percussive air tool as defined in claim 1 wherein a ring shell is secured to the outer surface of said housing by means of shock-absorbing elements, the ring shell being rigidly connected to said air feeding valve.

4. A percussive air tool as defined in claim 2 wherein the ratio between the volumes of said return stroke chamber and said work stroke chamber is within $\frac{1}{3}$ to $\frac{1}{4}$.

5. A percussive air tool as defined in claim 3 wherein the ratio between the volumes of said return stroke chamber and said work stroke chamber is within $\frac{1}{3}$ to $\frac{1}{4}$.

6. A percussive air tool for driving into the ground and withdrawing therefrom substantially rod-like pieces, said tool comprising: a hollow tubular housing having a stepped inner wall and pair of spaced ends; air inlet and air exhaust ports positioned in said housing between the ends thereof; a hammer having a stepped outer surface and slidably disposed inside said housing for axial reciprocation therein, said hammer having a central axial bore extending therethrough and including a front face, a rear face axially spaced from said front face, and an intermediate neck portion of reduced outer diameter between said front and rear faces to define a stepped outer surface having two stepped portions separated by said intermediate neck portion, one of said stepped portions being greater in diameter than the other, said intermediate neck portion spaced inwardly from the inner wall of said hollow housing and defining a first stroke chamber therebetween and radially outwardly of said hammer; a tubular member positioned coaxially within the axial bore of said hammer and spaced inwardly therefrom, said tubular member supported in said housing to define with said hammer and said housing a second stroke chamber radially inwardly of and adjacent the rear face of said hammer and independent of said first stroke chamber, said air exhaust port including at least one opening in said housing intermediate the ends thereof for communication alternately with said first stroke chamber and said second stroke chamber so each of said chambers alternately communicates with the same at least one opening; an air supply hose pipe including an air flow control valve for feeding compressed air alternately to said stroke chambers through said air inlet port; a rod-clamping means arranged in a forward portion of said housing; said neck portion of said hammer positioned at a smallest step of said hammer to communicate said air inlet port with said first stroke chamber; and said second stroke chamber including a continuous annular cavity formed by an outer wall of said tubular member and said axial bore of said hammer, said second stroke chamber extending from the front face of said hammer to the rear face thereof, said annular cavity providing continuous communication between the front and rear faces of said hammer.

* * * * *